US008333042B2

(12) United States Patent
Frederiksen

(10) Patent No.: US 8,333,042 B2
(45) Date of Patent: Dec. 18, 2012

(54) SLIP-STOP

(75) Inventor: Ole Frederiksen, Hornslet (DK)

(73) Assignee: Excellent Systems A/S, Morke (DK)

( * ) Notice: Subject to any disclaimer, the term of this patent is extended or adjusted under 35 U.S.C. 154(b) by 0 days.

(21) Appl. No.: 12/735,565

(22) PCT Filed: Jan. 27, 2009

(86) PCT No.: PCT/DK2009/050029

§ 371 (c)(1),
(2), (4) Date: Aug. 25, 2010

(87) PCT Pub. No.: WO2009/095026

PCT Pub. Date: Aug. 6, 2009

(65) Prior Publication Data

US 2010/0325977 A1 Dec. 30, 2010

(30) Foreign Application Priority Data

Jan. 28, 2008 (DK) ..... 2008 00107

(51) Int. Cl.
*E04F 11/16* (2006.01)
*E04F 15/00* (2006.01)

(52) U.S. Cl. ..... 52/177; 52/582.1

(58) Field of Classification Search ..... 52/177, 52/656.2, 656.4, 384, 385, 386, 179, 180, 52/582.1, 263

See application file for complete search history.

(56) References Cited

U.S. PATENT DOCUMENTS

| | | | | |
|---|---|---|---|---|
| 4,361,614 | A * | 11/1982 | Moffitt, Jr. | 428/138 |
| 4,749,191 | A * | 6/1988 | Gipson et al. | 280/164.2 |
| 5,456,966 | A * | 10/1995 | Austin | 428/120 |
| RE35,369 | E * | 11/1996 | Ducroux et al. | 52/126.6 |
| 6,372,323 | B1 * | 4/2002 | Kobe et al. | 428/119 |
| 6,508,037 | B1 * | 1/2003 | Owen | 52/220.1 |
| 6,673,417 | B1 * | 1/2004 | Gudet | 428/156 |
| 6,718,714 | B1 * | 4/2004 | Montgomery, Sr. | 52/392 |
| 6,857,230 | B2 * | 2/2005 | Owen | 52/126.6 |
| 7,162,839 | B2 * | 1/2007 | Ohno et al. | 52/180 |
| 7,454,869 | B2 * | 11/2008 | Owen | 52/263 |
| 7,587,865 | B2 * | 9/2009 | Moller, Jr. | 52/181 |
| 7,908,802 | B2 * | 3/2011 | Frederiksen | 52/177 |
| 8,146,302 | B2 * | 4/2012 | Sippola | 52/177 |
| 2002/0018877 | A1 | 2/2002 | Woodall | |
| 2003/0066253 | A1 * | 4/2003 | Lin | 52/177 |
| 2004/0074176 | A1 * | 4/2004 | Baker | 52/263 |
| 2004/0139671 | A1 * | 7/2004 | Owen | 52/263 |
| 2007/0204539 | A1 * | 9/2007 | Owen | 52/263 |

FOREIGN PATENT DOCUMENTS

| | | |
|---|---|---|
| DE | 2213282 | 10/1972 |
| DE | 3315180 | 10/1984 |
| DE | 3511302 | 10/1986 |
| DE | 3738762 | 5/1989 |

(Continued)

*Primary Examiner* — Mark Wendell

(74) *Attorney, Agent, or Firm* — James Creighton Wray

(57) ABSTRACT

Element to prevent slipping on surfaces, where the surfaces are provided with a plurality of apertures, characterized in that the element comprises a base plate, and that a plurality of towers extend upwards from said base plate, where the towers have a cross section at least at an upper part, corresponding to the shape of the apertures in the surface, and that the towers are arranged on the base plate in a pattern corresponding to the pattern of the apertures in the surface.

11 Claims, 2 Drawing Sheets

FOREIGN PATENT DOCUMENTS

| | | |
|---|---|---|
| JP | 11131739 | 5/1999 |
| WO | 0102667 | 1/2001 |
| WO | 0125539 | 4/2001 |
| WO | 2006045309 | 5/2006 |

* cited by examiner

SLIP-STOP

This application claims the benefit of Danish Application No. PA 2008 00107filed Jan. 28, 2008and PCT/DK2009/050029 filed Jan. 27, 2009, which are hereby incorporated by reference in their entirety as if fully set forth herein.

FIELD OF THE INVENTION

The present invention relates to an element to prevent slipping on surfaces. This type of element is specifically developed in order to be used in conjunction with the applicant's prior inventions which have been published in international patent applications WO 2006045309 and WO 0102667.

Although these tiles have a specific configuration, the present invention directed to an element for preventing slippage may be used in conjunction with other tiles or surfaces where the surface as such, exhibits the same characteristics, namely that apertures are provided in said surface. Other surfaces which may be considered in this connection may be for example gratings used in pedestrian or entrance areas and the like.

BACKGROUND OF THE INVENTION

One problem with the tiles disclosed in the patent applications mentioned above is the fact that they may become slippery when wet. In particular when the tiles are made from injection moulded plastics, rubberizes soles, wheels and the like may have difficulties in gaining traction on these surfaces during wet periods and also when a layer of ice has been formed on the surface.

From DE 2213282 is known a construction wherein an element comprising a plurality of upwards facing dimples arranged on a base member, and where further apertures are arranged in between the dimples in the base member. The apertures are arranged such that the element may be lowered over a surface comprising a number of upstanding protrusions. In this manner the dimples increases the effective surface as they will be present in between the protrusions. At the same time the dimples are dimensioned such that they do not protrude above the original surface. With this construction is achieved that the effective surface area is increased, and the possibility of achieving friction between objects and the surface is thereby also increased. A drawback with this construction, however, is that it is not suitable for outdoor use under conditions where rain, sleet, snow and ice may be present. Under such conditions the surface will "fill up" and due to the space provided between the upstanding protrusions and the dimples, the rain, sleet, snow and ice will be trapped in the construction, thereby rendering the surface without the desired friction.

OBJECT OF THE INVENTION

It is therefore an object of the present invention to provide an element which over-comes the drawbacks of the prior art, and in particular when arranged in conjunction with the applicant's prior inventions, provide traction such that users regardless of footwear may gain traction and friction on said surfaces.

DESCRIPTION OF THE INVENTION

This is accomplished by an element designed to prevent slipping on surfaces where the surfaces are provided with a plurality of apertures, characterised in that the element comprises a base plate, and that a plurality of towers extend upwards from said base plate, where the towers have a cross section at least at an upper part, corresponding to the shape of the apertures in the surface, and that the towers are arranged on the base plate in a pattern corresponding to the pattern of the apertures in the surface.

As the element is provided with towers where the towers are arranged in a pattern, corresponding to the pattern of the apertures in the surface, it is possible from the rear side of the tile/surface to insert the element according to the invention through the apertures in the surface such that at least the top of the tower will extend from the surrounding surface. A pedestrian or wheelchair travelling across the surface will therefore be able to engage the top of the towers and/or the surface and in this manner gain traction/friction and thereby achieve a strong, firm and reliable foothold when travelling on this type of surfaces. The base plate assures the stability of the towers such that during use the towers will be kept in a relatively fixed position in relation to the surface and the apertures provided in the surface.

In a further advantageous embodiment the towers will have a cross section which is circular, oval or polygon in shape. That is to say that the cross sectional shape of the towers may be completely chosen in correspondence with the shape of the apertures provided in the surface, such that the towers may be inserted through the apertures in the surface. Also, it is contemplated within the scope of the present invention that the towers may have a different cross sectional shape than the apertures provided in the surface, whereby the towers will only fill out part of the apertures, but as long as sufficient area is maintained on top of the tower in order to provide the desired traction/friction between a user and the surface, the mutual shape of the apertures and the surface and the cross sectional shape of the tower is irrelevant. By designing the apertures and the towers differently, aesthetic design options may be available which according to the particular use may be particularly desirable.

In a further advantageous embodiment at least the towers are made from a resilient material. By using resilient materials in order to manufacture the towers, e.g. during an injection moulding process, it is achieved that when a user is travelling across a surface provided with elements according to the present invention and the towers extend slightly above the surface, the engagement with e.g. a user's foot will depress the tower to the level of the supporting surrounding surface, whereby good traction may be achieved between the tower and the foot sole and at the same time the surrounding surface and a foot sole. This is important in that e.g. if the towers are manufactured from a rubber-like material suitable for injection moulding, good traction may be obtained between shoes having a corresponding plastic moulded sole, whereas for shoes with leather soles, better traction may be achieved between the surrounding surface and the sole of the foot. In this manner, by providing resilient towers the best characteristics of both materials may be utilized during use.

In a further advantageous embodiment of the invention distance keepers are arranged on at least some of the towers, arranged at a predetermined distance from the upper part towards the base plate, where the towers at cross sections including distance keepers have a larger cross section than the upper part of the towers. The distance keepers serve to limit the length of tower which may penetrate through the aperture in the surface such that the extension of the towers above the surface may be limited and predetermined in order to provide a surface where the combination of anti-slip elements according to the present invention and the other characteristics of that particular surface may be combined in order to provide all the advantages achievable with the combination of features from the inventive element and the surface.

Typically, the distance keepers are arranged such that when the element is arranged under the surface such that the upper part of the towers project through the apertures in the surface, the tower extends 0.5-2 mm above the surface. At this height and with relatively even distribution of towers in a surface, it is achieved that the combined surface including elements of the present invention does not provide hindrance for traffic on that surface, and will not be felt obstructive and thereby serve the purpose of providing a safer surface to be traveled by a user.

In a still further advantageous embodiment of the invention the towers have a cross sectional size slightly smaller than the size of the apertures, such that when the element is arranged in the surface, play is present between the aperture and the tower.

As already mentioned above with respect to the embodiment of the invention where the towers are made from resilient material, additional movement of the tower relative to the surface may be attained by providing play between the aperture and the tower. This is particularly interesting in situations where water may be present on the surface in that the distance between the tower and the aperture provides for draining. Should it, however, be difficult to drain all water away and frost should occur, a thin layer of ice will be present on top of the surface which may constitute a hazard to users of that particular surface. By either manufacturing the element from a resilient material, or providing play between the tower and apertures in the surface, the ice will to a large extent crack and crumble when exposed to use due to the resiliency and/or movement of the towers due to the play between the tower and the aperture, whereby friction/traction is restored to that surface without the use of heat or salt. These aspects thereby provide added safety and usability simply be designing the element according to the invention according to the circumstances.

Further advantageous embodiments of the invention will be discussed below.

The invention furthermore relates to a kit of parts comprising element parts for the module construction of ramp or surface formations, comprising primarily relatively low, wedge-shaped ramp elements with suitable, slightly inclined upper surfaces, such as with a wedge-angle of 10-20° and preferably with a greatest height of 10-50 mm, and secondary flat tile elements of the same height as the greatest height of the associated ramp elements wherein both the ramp elements and the flat tile elements are built up as shell elements with a top shell defining a surface configured with a pattern of through-going apertures where further coupling pieces may be utilised for the vertical fixing of elements to underlying elements by the pressing of snap-lock coupling pieces down through respectively associated holes, and where one or more elements according to any of claims 1 to 8 may be inserted from the underside of the surfaces, where each element comprises a base plate, and a plurality of towers extend upwards from said base plate where the towers have a cross section at least at an upper part, corresponding to the shape of the apertures in the surface, and where the towers are arranged on the base plate in a pattern corresponding to the pattern of the apertures in the surface.

This embodiment is specifically directed at using the present invention relating to an element having a base plate and towers in combination with one or more tiles according to the inventor's prior applications mentioned in the introductory part of the description. By this combination the advantages mentioned above with respect to the various embodiments of the invention as well as the advantages derivable from the inventions in the prior applications may be combined in order to provide a very advantageous surface system having a multitude of applications.

DESCRIPTION OF THE DRAWING

The invention will now be described with reference to the accompanying drawing wherein

Turning to FIG. 1 an element 1 according to the invention is illustrated. The element 1 comprises a base plate 2 on which a plurality of towers 3 are arranged in rows 4-8 with five towers in each row. Except for row 7 where one of the towers has been replaced by a special aperture 9 which will be explained below.

Figure 1:
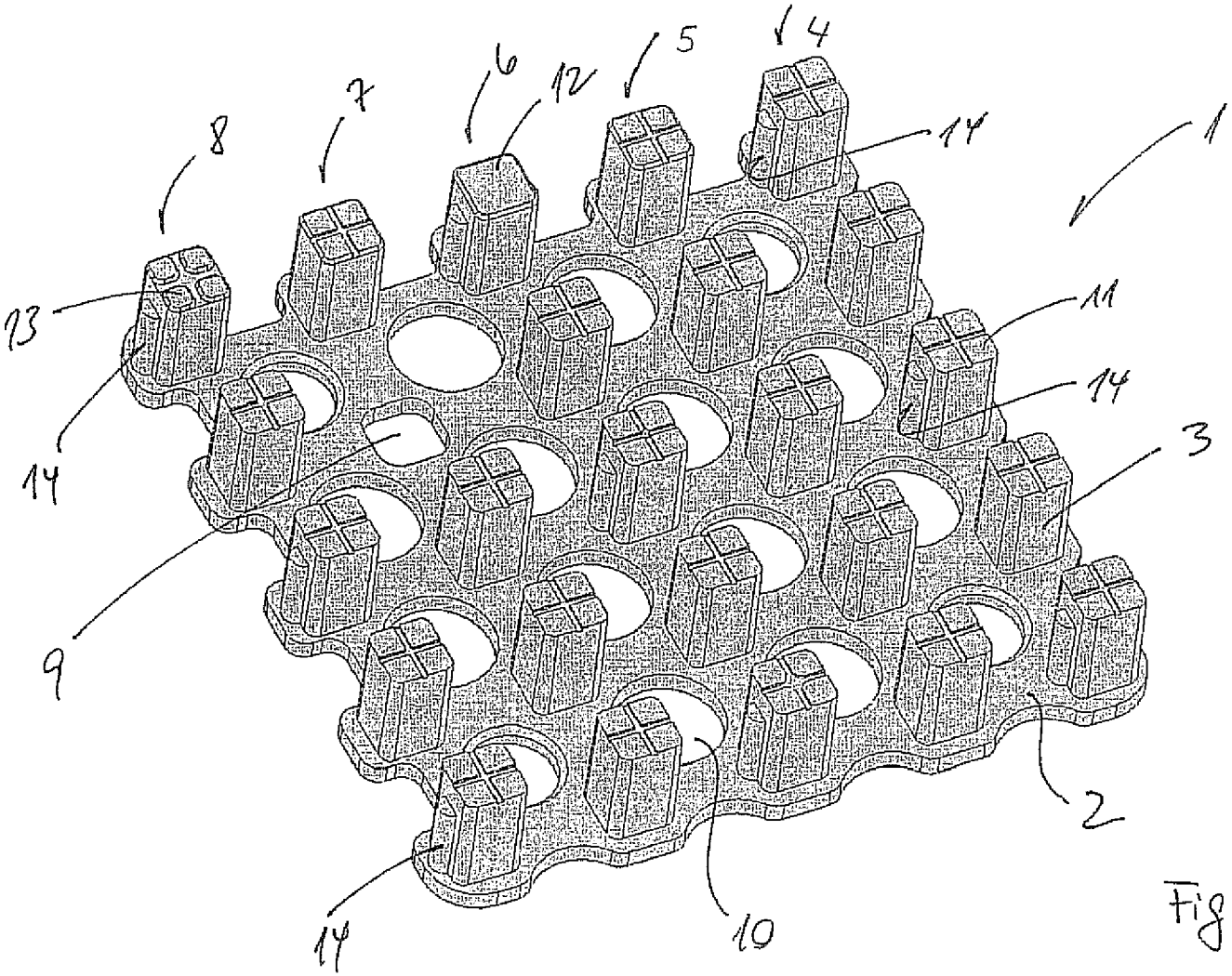
FIG. 1 illustrates an isometric view of an element according to the invention

The base plate 2 is furthermore provided with apertures 10 which are mainly provided in order to save material, but also have a draining effect in the applications where the cross section of the towers is less than the cross section of the corresponding apertures provided in the surface such that water, debris and other materials may be drained through the gaps provided between the towers and the apertures in the surface. In this embodiment the top of the tower 11 is provided with a pattern such that also the top of the tower improves the traction/friction between a user and a tower. Different suggestions on patterns are illustrated with reference number 11, 12 and 13. In this context it should be emphasized that the illustrated patterns are only suggestions and that a skilled person will be able to provide any desired pattern on the top of the towers in order to create a desired design or desired traction characteristics for that particular element 1.

Some of the towers 3 are provided with distance keepers 14 such that it is limited how much the top of the tower 11 may project through the apertures in that the distance keepers 14 will engage the rear surface of the surface on which the elements are installed and thereby limit the extension of the tower through the apertures. In this embodiment the towers are furthermore illustrated with slanting sides such that the cross sectional area at the top of the tower is less than the cross sectional area at the foot of the tower where it is engaging the base plate 2. The slanting characteristics of the sides of the towers will also limit the length of the extent through the apertures in the surface in that the sides of the tower will engage the sides of the apertures whereby further insertion will be limited.

The aperture having as illustrated a generally square cross section is suitable for use in connection with the applicant's prior inventions published as WO 2006045309 and WO 0102667 in that here the different tile elements may be stacked one on top of the other and superposed such that snap lock elements may be inserted in order to fasten two superposed tiles.

The aperture 9 is designed such that the snap lock element may pass through this aperture and thereby help to stabilize the entire sandwich by allowing the snap lock element to penetrate through the base plate 2 of the present invention.

With respect to the drawings the towers are illustrated as generally having a square or rectangular shape, but it is of course possible to have any types of shapes of the towers as long as they fit inside the apertures provided in the surface with or without play.

Figure 2:
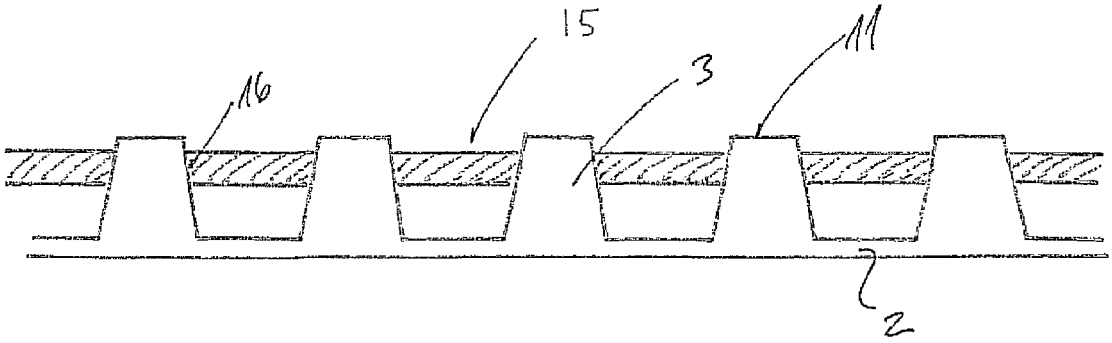
FIG. 2 illustrates a cross section through an element installed in a surface.

Turning to FIG. 2, a schematic cross section through a surface 15 through which a number of towers 3 extend such that the top of the towers 11 extends above the surface 15. In this example the shape of the towers 3 is designed such that they fit snugly into the apertures 16 provided in the surface such that no play is available. In these embodiments it is not necessary to provide distance keepers 14 (see FIG. 1) as the tight fit between the towers 3 and the apertures 16 provided in the surface 15 will limit the extent to which the tower 3 penetrates through the apertures 16 and thereby extends above the surface 15.

The invention claimed is:

1. Element to prevent slipping on surfaces, where said element comprises a surface element and a base plate, where the surface element is provided with a plurality of through apertures, wherein a plurality of towers extend upwards from said base plate, wherein said towers have a cross section at least at an upper part, corresponding to the shape of the apertures in the surface element, and that said towers are arranged on said base plate in a pattern corresponding to the pattern of the apertures in the surface element, wherein said towers extending from said base plate are suitable to be inserted from the rear side of said surface element, such that parts of said towers extend through the apertures and thereby extend through said surface element adjacent the apertures, wherein the base plate in at least one position instead of a tower is provided with an opening, said opening having a shape and size corresponding to the apertures provided in said surface element.

2. The element according to claim 1 wherein said towers have a circular, oval, or polygon cross sectional shape.

3. The element according to claim 1 wherein at least said towers are made from a resilient material.

4. The element according to claim 1 wherein distance keepers are arranged on at least some of said towers and where said distance keepers are arranged at a predetermined distance from said upper part towards said base plate, where the towers at cross sections including distance keepers have a larger cross section than the upper part of the towers.

5. The element according to claim 4 wherein said distance keepers are arranged such that when said base plate is arranged under the surface element such that the upper part of the towers project through said apertures in said surface element, the tower extends 0.5-2 mm above the surface.

6. The element according to claim 1 wherein said towers have a cross sectional size slightly smaller than the size of said apertures, such that when the element said base plate is arranged in said surface element, play is present between said aperture and the tower.

7. The element according to claim 1 wherein the base plate is rectangular or quadratic and is provided with towers arranged in arrays of four to ten towers in each direction, and where the towers extend between 10 to 20 mm, and where further the distal ends of each tower may be provided with a non-slip pattern.

8. The element according to claim 1 wherein the base plate is rectangular or quadratic and is provided with towers arranged in arrays of four to ten towers in each direction, and where the towers extend between 12 to 18 mm and where further the distal ends of each tower may be provided with a non-slip pattern.

9. The element according to claim 1 wherein the base plate is rectangular or quadratic and is provided with towers arranged in arrays of four to ten towers in each direction, and where the towers extend between 15 to 17 mm and where further the distal ends of each tower may be provided with a non-slip pattern.

10. A kit of parts comprising element parts for the module construction of ramp or surface formations, comprising primarily relatively low, wedge-shaped ramp elements with suitable, slightly inclined upper surfaces, with a wedge-angle of 10-20° and with a greatest height of 10-50 mm, and secondary flat tile elements of the same height as the greatest height of the associated ramp elements wherein both the ramp elements and the flat tile elements are built up as shell elements with a top shell defining a surface element configured with a pattern of through-going apertures where further coupling pieces are utilised for the vertical fixing of elements to underlying elements by the pressing of snap-lock coupling pieces down through respectively associated holes, and where one or more base plates according to claim 1 are inserted from the underside of the surface elements, where each base plate comprises a plurality of towers, where said towers extend upwards from said base plate where the towers have a cross section at least at an upper part, corresponding to the shape of the apertures in the surface element, and where the towers are arranged on the base plate in a pattern corresponding to the pattern of said apertures in said surface element.

11. Apparatus comprising elements to prevent slipping on surfaces wherein said elements further comprise a surface element and a base plate, where the surface element is provided with a plurality of through apertures, wherein a plurality of towers extend upwards from said base plate, wherein said towers have a cross section at least at an upper part, corresponding to the shape of the apertures in the surface element, and that said towers are arranged on said base plate in a pattern corresponding to the pattern of the apertures in the surface element, wherein said towers extending from said base plate are suitable to be inserted from the rear side of said surface element, such that parts of said towers extend through the apertures and thereby extend through said surface element adjacent the apertures.

* * * * *